US007252717B2

(12) United States Patent
Barnard et al.

(10) Patent No.: US 7,252,717 B2
(45) Date of Patent: Aug. 7, 2007

(54) METHOD AND APPARATUS FOR CLEANING MACHINES

(75) Inventors: Gavin Perryman Barnard, Auckland (NZ); Barry Wallace Barmby, Auckland (NZ)

(73) Assignee: Innovative Systems Technologies, Auckland (NZ)

( * ) Notice: Subject to any disclaimer, the term of this patent is extended or adjusted under 35 U.S.C. 154(b) by 650 days.

(21) Appl. No.: 10/344,205

(22) PCT Filed: Aug. 9, 2001

(86) PCT No.: PCT/NZ01/00161

§ 371 (c)(1),
(2), (4) Date: Sep. 22, 2003

(87) PCT Pub. No.: WO02/12689

PCT Pub. Date: Feb. 14, 2002

(65) Prior Publication Data

US 2004/0035640 A1 Feb. 26, 2004

(51) Int. Cl.
*B08B 3/08* (2006.01)

(52) U.S. Cl. ..... 134/10; 134/26; 134/27; 134/36; 134/37

(58) Field of Classification Search ..... 134/10, 134/22.1, 22.18, 94.1, 95.1, 97.1, 103.1, 134/111, 167 C, 169 C, 26, 27, 34, 36, 37; 123/198 A See application file for complete search history.

(56) References Cited

U.S. PATENT DOCUMENTS 4,909,207 A * 3/1990 Takano et al. ..... 123/198 A
5,063,896 A * 11/1991 Hyatt et al. ..... 123/198 A
5,383,207 A * 1/1995 Culverhouse et al. ..... 372/28

* cited by examiner

*Primary Examiner*—Michael Barr
*Assistant Examiner*—Saeed Chaudhry
(74) *Attorney, Agent, or Firm*—Morgan & Finnegan, LLP

(57) ABSTRACT

A method of cleaning a lubrication system of a machine includes removing existing lubricant and circulating a cleaning fluid through the lubrication system. After the cleaning fluid has been removed, a neutralising fluid is circulated through the lubrication system, whereby the neutralising fluid combines or reacts with the cleaning fluid to produce a fluid that does not adversely affect the lubricating qualities of fresh lubricating fluid. An apparatus (1) for carrying out the method includes first (3) and second (15) reservoirs to receive the cleaning fluid and neutralising fluid respectively, one or more connectors to connect the apparatus to the machine, one or more pumps adapted to circulate cleaning fluid and neutralising fluid and a controller to control the transfer of the cleaning fluid and neutralising fluid from the reservoirs to the machine.

12 Claims, 6 Drawing Sheets

METHOD AND APPARATUS FOR CLEANING MACHINES

TECHNICAL FIELD

The present invention relates to a method and apparatus for use in cleaning machines. More particularly, although not exclusively, the present invention relates to a method and apparatus which are particularly adapted to remove impurities, wear metals and contaminant deposits from lubrication systems of engines including internal combustion or compression ignition engines and gear systems.

BACKGROUND ART

Any discussion of the prior art throughout the specification should in no way be considered as an admission that such prior art is widely known or forms part of common general knowledge in the field.

It is well known that the use of lubrication fluids such as oils and similar substances to lubricate engines can result in the accumulation of impurities, abrasion contaminants and other unwanted by-products. An example of this is the build-up which accumulates in motor vehicle engines over time. These substances are often produced when the lubricating fluid is heated when the engine is running. These unwanted by-products include varnish, carbon deposits, mineral and acid deposits, all of which can accumulate on the internal metal surfaces of an engine. As noted above, these deposits build up as a result of heating the oil and of blow-by from the combustion processes. The extent of this build up of unwanted deposits is determined generally by the condition of the engine and the operating regime. However, contaminant build up and wear from friction is known to occur, to some extent, in all engines.

A further source of wear in an engine resides in the build up of what are known as "wear metals" in the internal volumes of the engine. Wear metals are produced by friction between moving parts of the engine. This produces a suspension of fine metal particles which are suspended in the lubricating fluid. These can accumulate where there is insufficient or low through-flow of the lubricating fluid. The presence of wear metals not only damages the engine but also adversely affects the friction reducing properties of the lubricating fluids. It can therefore contribute significantly to excess wear of metal-to-metal interfaces in the engine.

Simply changing the oil does not generally totally overcome such problems as wear metals are known to cling to or build up in the film of residual oil which is found on the most internal surfaces of the engine. When a fresh or clean batch of oil is poured into the engine, the oil film mixes with the fresh oil thus distributing the wear metal particles into the fresh oil batch. Changing the oil is also at least partly ineffective in removing varnish, carbon build ups or mineral or acid deposits.

A further contaminant found in engines is "sludge". Sludge is produced as a result of the breakdown of lubricating oil, when combined with water, acid vapour, and exhaust gas blow-by under conditions of extreme heat and pressure. Such conditions can result from short engine run times, cool engine operating temperatures, overheating or long storage periods. Sludge clings to the internal surfaces of the engine and is not easily removed by "normal" oil changing.

It is known to use flushing solutions with either petrol or diesel engines to remove the above mentioned unwanted deposits, see the patent specifications published as U.S. Pat. No. 4,174,231 and international publication number WO95/17979.

Existing cleaning systems have little in the way of quality control to ensure that the correct fluids are used for correct amount of time and that the engine is operated correctly during cleaning.

Therefore, the user may inadvertently use the incorrect fluids, use them for too long or too short a period or under the wrong operating conditions, reducing the effectiveness of the cleaning cycle and/or potentially damaging the engine.

A problem with existing cleaning systems is that invariably a proportion of the cleaning fluid is retained within the engine. This contaminates the new oil introduced after cleaning, reducing the quality of the oil.

It is therefore an object of the present invention to provide a method and apparatus for removing waste products or undesirable build-ups from lubrication systems in engines which overcomes or at least alleviates problems in engine cleaning systems at present or at least to provide the public with a useful choice.

Further objects of the present invention may become apparent from the following description.

DISCLOSURE OF THE INVENTION

According to one aspect of the present invention, there is provided a method of cleaning a lubrication system of a machine including:

removing existing lubricating fluid from the machine;

circulating a cleaning fluid through the machine;

removing the cleaning fluid from the machine;

circulating a neutralising fluid through the machine, wherein the neutralising fluid is adapted to combine or react with the cleaning fluid to produce a fluid that does not adversely affect the lubrication characteristics of fresh lubricating fluid when mixed with the fresh lubricating fluid; and removing the neutralising fluid from the machine.

Preferably, the method may further include refilling the machine with a required amount of said fresh lubrication fluid.

Preferably, the method may further include circulating the cleaning fluid through the machine more than once and passing the cleaning fluid through at least one filter for each cycle.

Preferably, the method may include operating the machine while the cleaning fluid is within the machine.

Preferably, the method may include circulating the neutralising fluid through the machine while the machine is not operating.

Preferably, the method may further include feeding compressed air into the machine through an inlet as the cleaning fluid is being removed from the machine.

Preferably, the method may further include mixing a lubricant with the compressed air and circulating the mixture through the machine.

Preferably, the method may include circulating the cleaning fluid and/or neutralising fluid for a predetermined time.

Preferably, the machine may be an internal combustion engine.

According to another aspect of the present invention, there is provided a machine cleaning apparatus including:

first and second reservoirs to receive a cleaning fluid and a neutralising fluid respectively;

one or more connectors to connect the apparatus to the machine to allow the cleaning fluid and the neutralising fluid to be transferred though a connector into and out of the machine;

one or more pumps adapted to circulate cleaning fluid from the first reservoir and neutralising fluid from the second reservoir through a machine;

a controller to control the transfer of the cleaning fluid and neutralising fluid from the reservoirs to the machine, wherein the controller is adapted to transfer the neutralising fluid into the machine after cleaning fluid has been circulated through the machine.

Preferably, the apparatus may be adapted to circulate compressed air through the machine.

Preferably, the apparatus may be adapted to mix a lubricant with the compressed air and circulate a resulting air and lubricant mixture through the machine.

Preferably, the apparatus may be adapted to simultaneously remove the cleaning fluid from the machine and transfer compressed air into the machine.

Preferably, the apparatus may further include a machine operation sensor to detect when the machine is operating, whereby the controller is adapted to control the time that the machine is operated after the cleaning fluid has been transferred into the machine.

Preferably, the controller may allow removal of the cleaning fluid from the machine only after the machine operation sensor detects that the machine is not operating.

Preferably, the controller may be adapted to control the amount of cleaning fluid and/or neutralising fluid transferred into the machine dependent on the oil holding capacity of the machine.

Preferably, the apparatus may include an interface to allow a user to input the oil holding capacity of the machine for use in controlling the amount of cleaning fluid and/or neutralising fluid transferred into the machine.

Preferably, the apparatus may include a cleaning fluid checker to check that the amount of cleaning fluid held in the first reservoir is sufficient for the machine.

Preferably, the apparatus may be adapted to request a user to check the level of cleaning fluid after the cleaning fluid has been transferred into the machine and provide an interface for the user to specify if more or less cleaning fluid is required.

Preferably, the controller may be adapted to prevent the apparatus using the cleaning fluid, neutralising fluid and/or fresh oil unless information is entered via an interface which matches predetermined requirements for the cleaning fluid, neutralising fluid and/or fresh oil.

Preferably, the predetermined information may include the source of the cleaning fluid, neutralising fluid and/or fresh lubricant.

Preferably, the predetermined information may include one or more characteristics of the cleaning fluid, neutralising fluid and/or fresh oil.

Preferably, the predetermined information may include a specified volume of cleaning fluid, neutralising fluid and/or fresh oil.

Preferably, the information may include an identifier to specifically identify each container of cleaning fluid, neutralising fluid and/or fresh lubricant, wherein the apparatus is adapted to identify the volume of the container and prevent further use of the same container once the apparatus detects that the entire contents of that container have been used.

Preferably, the apparatus may be adapted to allow configuration of the controller.

Further aspects of the present invention, which should be considered in all its novel aspects, may become apparent from the following description, given by way of example only and with reference to the accompanying drawings.

MODES FOR CARRYING OUT THE INVENTION

Figure 1:
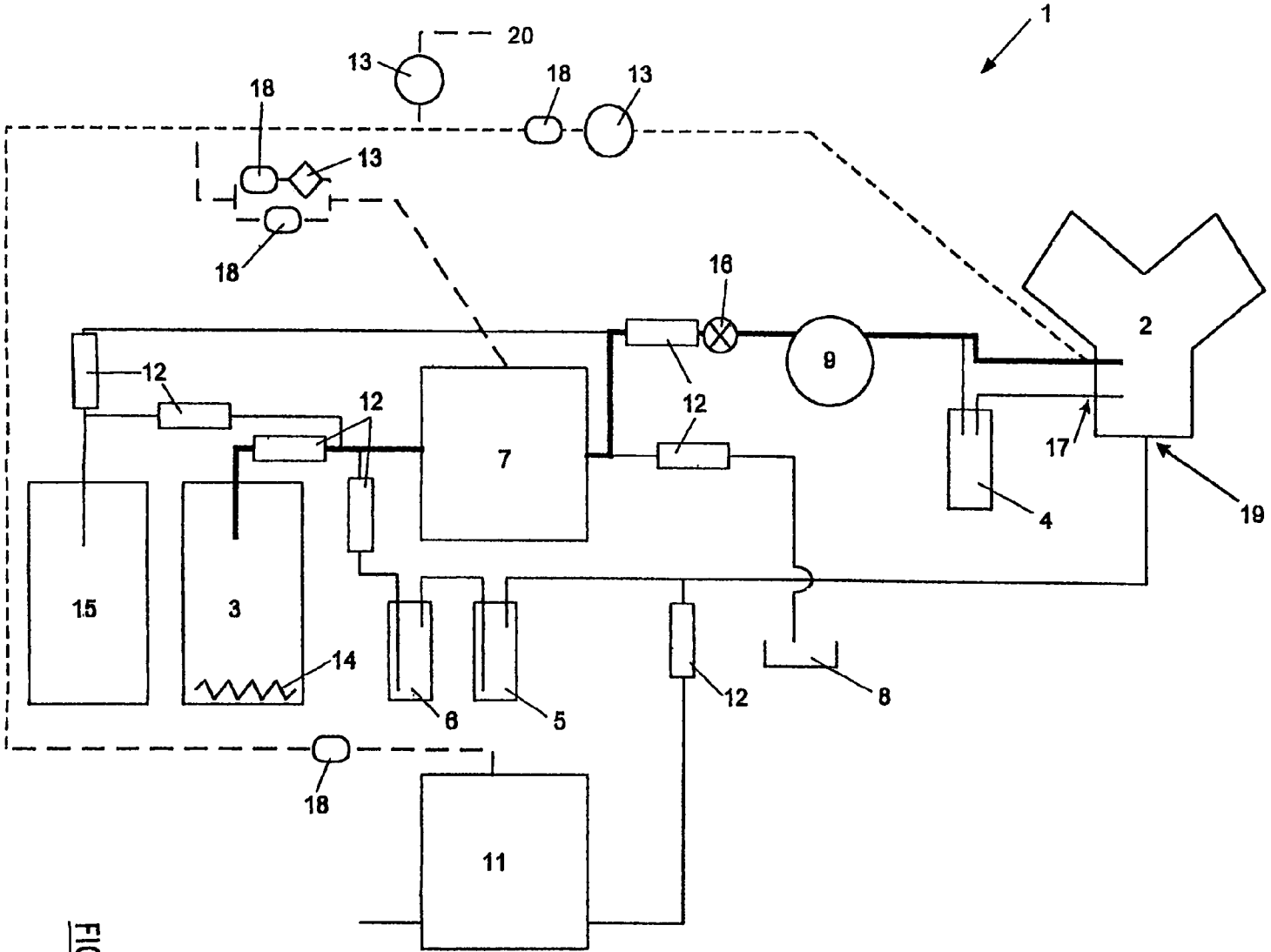
FIG. 1: Shows one embodiment of a machine cleaning apparatus of the present invention, illustrating the cleaning fluid machine fill cycle.

Referring to the accompanying drawings, a schematic representation of a cleaning apparatus, generally referenced 1 for cleaning a machine, in the figures an engine 2, is shown. The following description will be given with specific reference to application of the invention to lubrication systems of engines. However, the invention may be applied to other machines that include lubrication systems such as gears and other mechanical devices, in particular those which involve work transfer between components.

The apparatus 1 includes a tank 3 for holding a cleaning fluid. The cleaning fluid is preferably an oil-based substance including a solvent and anti-wear additives. There are many different options for the cleaning fluid, but it preferably has a viscosity sufficient to hold wear metals in suspension until the fluid is carried to a filter and of light enough grade to pass through fine filters. Also, the cleaning fluid should be safe to use in an engine which is running and not damage any internal seals or other components of the engine. A suitable cleaning fluid for the purposes of the present invention is Titan™ Heavy Duty Flushing Fluid 2864, available from Fuchs Lubricants (Australasia) Pty Ltd.

The apparatus may further include a controller (not shown), which may be a programmable logic controller or other processing device, which preferably includes a user interface to prompt the user to carry out the various steps required during the cleaning cycle and to monitor key processes to avoid incorrect operation of the apparatus 1. The interface also includes an input means such as a numerical keypad to enter information relevant to the cleaning cycle, for example pumping parameters.

The tank 3 may include a heater 14 to raise the temperature of the cleaning fluid, thereby reducing its viscosity to allow it to be more easily pumped through the engine 2. While heat from the engine may provide sufficient heat if the engine is being operated (kinetic cleaning), if a cleaning cycle without the engine being operated (static cleaning) is performed, the heater 14 may be required.

To clean the lubrication system of the engine 2, the oil is first drained from the engine 2 and the apparatus 1 connected to the engine 2. The sump plug of engine 2 is replaced by an adapter, which is adapted to fit the sump thread to fit a hose connected to the apparatus 1. The oil filter is removed and a further adaptable connector is attached. This connector may for example be a two part system adapted to fit any size of oil filter fitting and also screw into the oil line in the centre of an oil filter attachment. Connectors suitable for the purpose of connecting the apparatus 1 to an engine are known and therefore will not be described in detail herein.

Typically, a three micron filter 4 is included between the engine oil intake and sump plug attachment. A further five micron filter 5 is provided to filter neutralising fluid (see herein below) as it is returned to its reservoir 15.

Once the apparatus is connected to the engine 2, the apparatus 1 is turned on and the main pump 7 pumps cleaning fluid into the engine sump, thereby replacing the usual oil (the engine's previous oil charge being drained prior to cleaning). The flow of cleaning fluid through the apparatus 1 from tank 3 is shown by the bold lines in FIG. 1. A meter 16 is provided to monitor the volume of fluid transferred from tank 3 into engine 2.

Preferably the main pump 7 may be an air operated double diaphragm pump, which is controlled by the controller. The controller, in a preferred embodiment, may be a programmable logic controller or similar microprocessor-based device.

The controller controls the volume of cleaning fluid transferred and may include an interface to the user to allow the user to input the oil holding capacity of the engine 2 to be cleaned. Once entered, the controller may determine whether there is sufficient fluid in tanks 3 and/or 15 to provide an adequate supply of fluid and control the amount of fluid transferred. Signal communication between the controller and the output of a level detector may be used for this purpose.

To ensure consistent quality control as well as control over the operation of the apparatus 1, each quantity of cleaning fluid, neutralising fluid and/or fresh lubricating fluid may be identified by a unique identifier, such as a bar code. This bar code is assigned to the container of the fluid and scanned by a scanner prior to it being accepted (or rejected) by the system. This bar code system helps to ensure only correct fluids are pumped into the correct holding tanks. In addition, an identification device may be provided for authorised operators of the apparatus 1, to control who may operate it. It will be appreciated by those skilled in the art that any identifier other than a bar code may also or alternatively used. Examples include a pin number, password and access cards.

Once cleaning fluid has been transferred into the engine 2, the controller may prompt the user to operate the engine 2 to perform a "kinetic clean", in contrast to a "static clean" when the engine 2 is not operated. The apparatus 1 may incorporate an oil pressure gauge (not shown) on an external filter, for example between the sump plug and the apparatus 1 to ensure that there is oil pressure in the engine 2 when it is operated. The dipstick may be prompted to be checked by the operator to ensure that sufficient oil is present in the engine 11 and the apparatus may prompt the user to confirm when this has been performed. The user may specify whether more or less cleaning is required through a user interface and the controller will operate the apparatus 1 to add or remove fluid as required.

Figure 2:
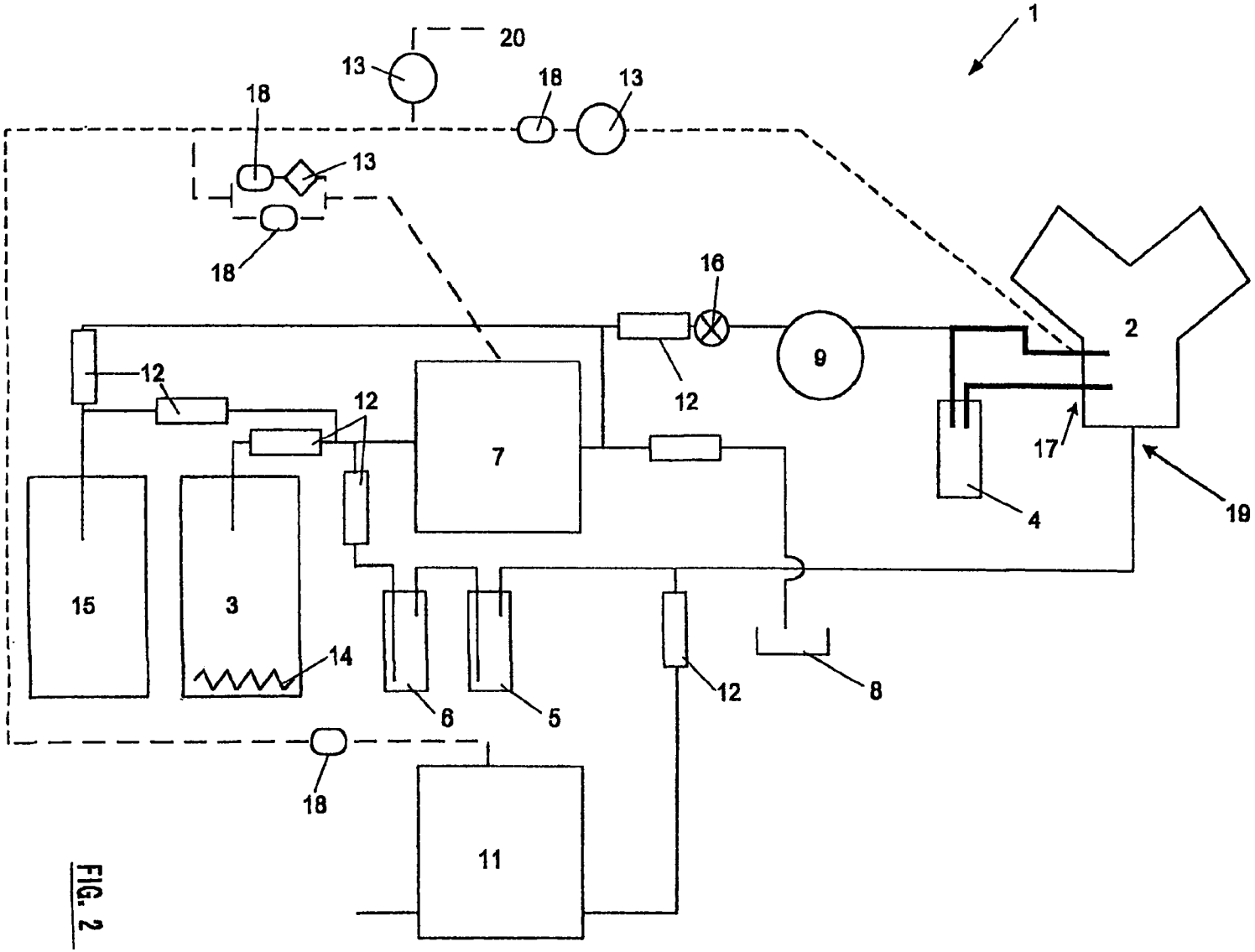
FIG. 2: Shows the apparatus of FIG. 1 in the kinetic cleaning part of the cleaning cycle.

FIG. 2 shows the circulation of cleaning fluid through the engine 2 and filter 4. The change in circulation is achieved through opening or closing appropriate valves, referenced 12 in the figures. The operation of the valves 12 is controlled by the controller, but at least selected valves 12 may include a manual override.

The apparatus 1 also includes an optional vibration detector (not shown) which can detect whether the engine 2 is operating or not. The vibration detector may be linked to the engine 2 and detects when the engine 2 is started. The vibration detection system, in a particular embodiment, simply uses a connection to the exhaust pipe or associated part of the engine 2. The controller may thus sense when the engine 2 starts and time a predetermined interval of cleaning time before prompting the user to turn off the engine 2. Of course in an alternative embodiment, the controller may be connected to the engine 2 to control its turn on and turn off.

If at any time during the cleaning of the engine 2, the vibration sensor detects that the engine 2 has stopped operating, the controller may prompt the user to perform a predetermined procedure. This procedure may be chosen to ensure the process is completed correctly.

Figure 3:
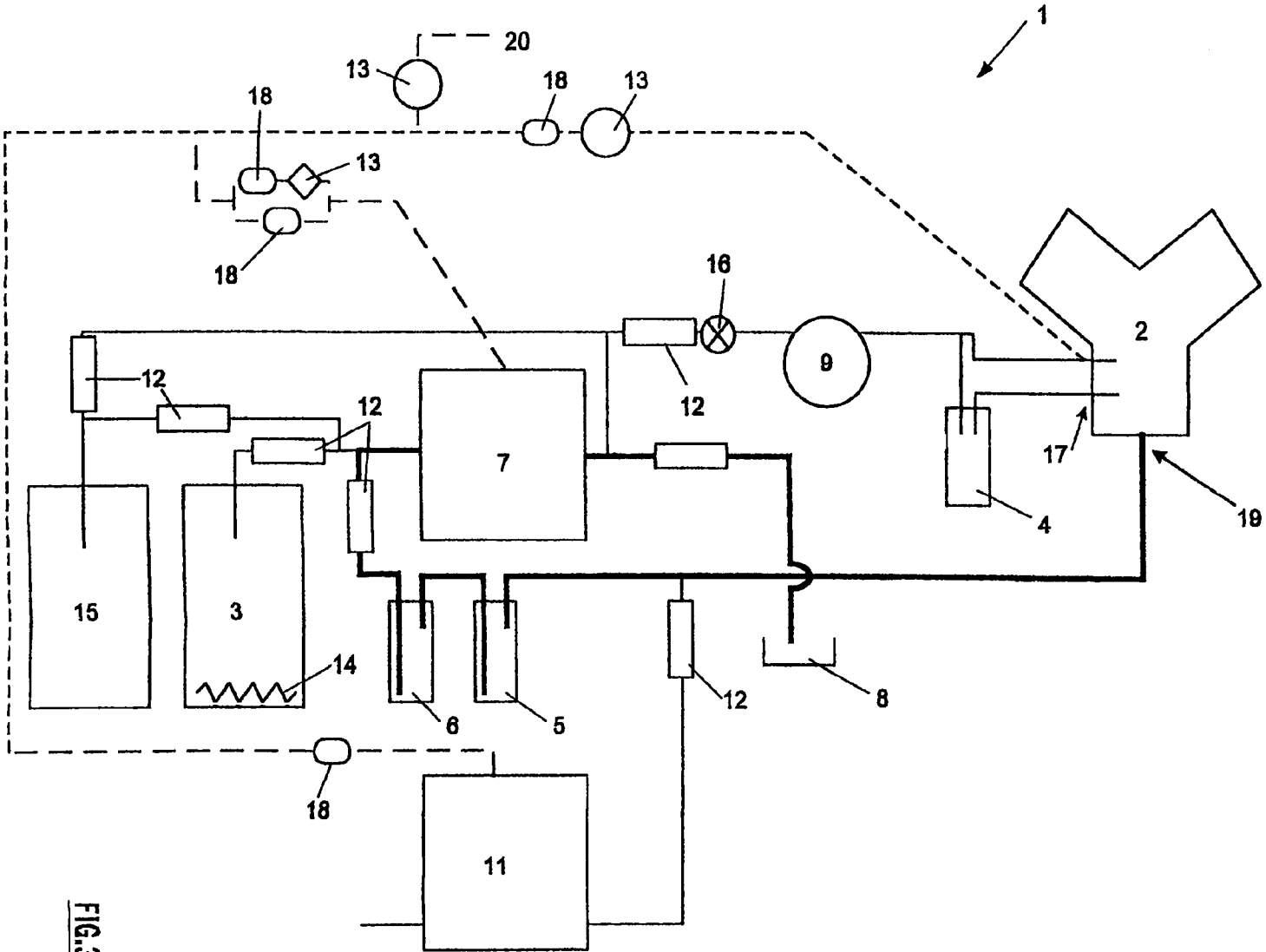
FIG. 3: Shows the apparatus of FIG. 1 in the fluid extraction to waste part of the cleaning cycle.

The cleaning fluid is then discarded to waste 8, as illustrated in FIG. 3. Air is allowed to enter the engine through an air inlet 20, following the paths represented by dashed lines in the figures dependent on the operation of the air valves 18. Air may also be provided to the main pump 7 and waste pump 11 as required. A waste pump 11 may be provided to facilitate draining of the engine 2 independent of the main pump 7.

For oil flushing, filter 4 is used. The connectors to the sump and oil filter aperture may be stored in a reel 9, which may be optionally sprung so as to retract the tubing when it is disconnected from the engine 2. The connector to the engine outlet 19 may also be stored in a reel (not shown).

In addition to performing a kinetic clean, the apparatus 1 may optionally also or alternatively perform a static flush of the engine 2. This may be performed using the same type of cleaning fluid as the kinetic clean. Alternatively, a separate supply of cleaning fluid may be used. A static clean may be performed without a kinetic clean, but the kinetic clean has the advantage of generally resulting in a more thorough and complete clean. If a static clean is required, the engine oil is drained from the engine 2, if it has not already been drained and the main pump 7 transfers the cleaning fluid from the tank 3 into the engine 2 as illustrated in FIG. 1 for the kinetic clean.

Figure 4:
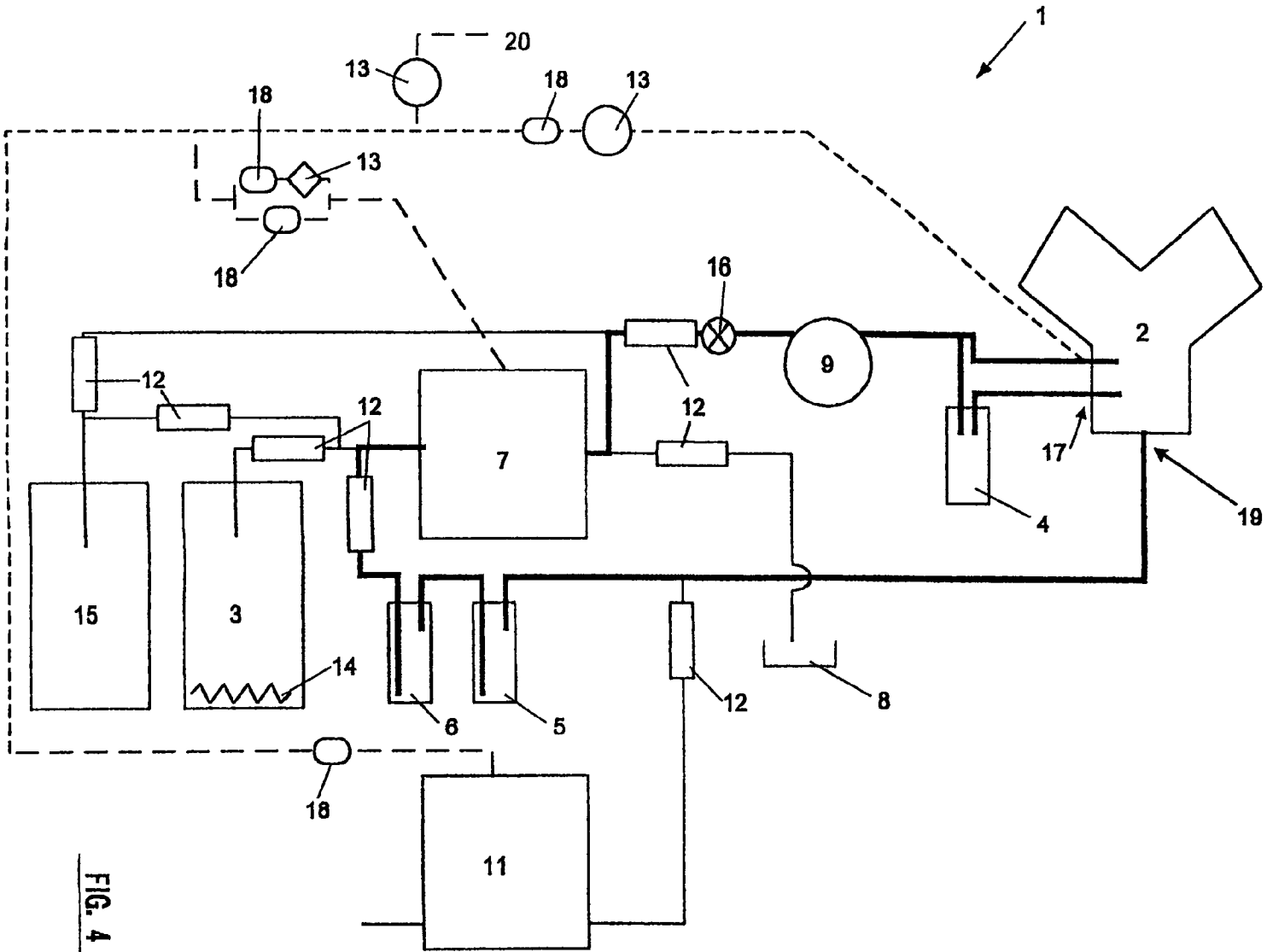
FIG. 4: Shows the apparatus of FIG. 1 in the fluid circulation part of the cleaning cycle.
Figure 5:
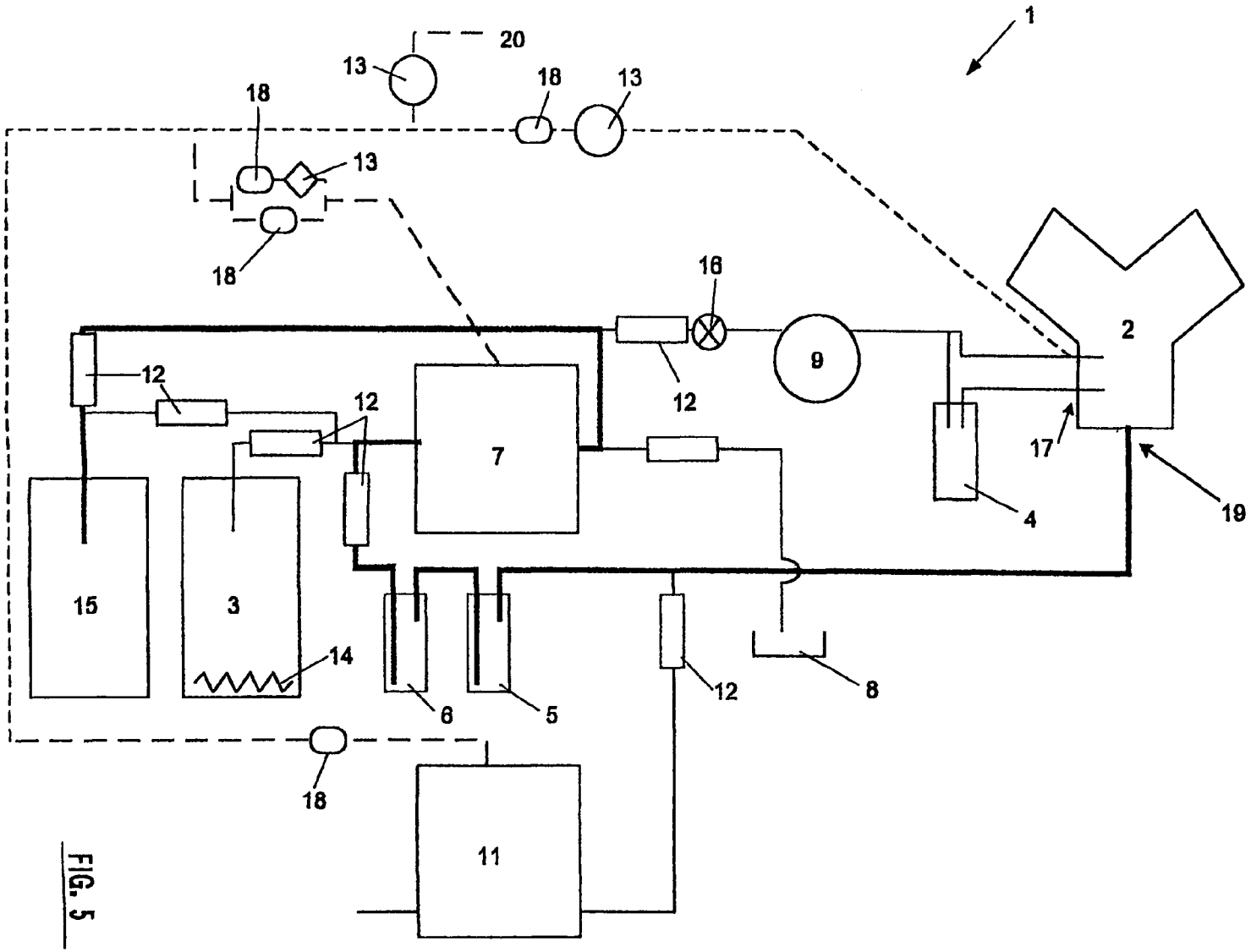
FIG. 5: Shows the apparatus of FIG. 1 in the cleaning and neutralising fluids extraction for re-use part of the cleaning cycle.

Once the cleaning fluid has been transferred into the engine 2, the main pump 7 circulates the cleaning fluid through the engine 2 as illustrated in FIG. 4. The cleaning fluid is extracted through the outlet 19 and filtered through filter 4 prior to re-entering main pump 7 for recirculation. After a specified period of time, which may be indicated by the controller, the circulation of cleaning fluid is stopped and the cleaning fluid may be returned to tank 3 via an additional valve and line from the main pump 7 to tank 3 (not shown), or sent to waste as shown in FIG. 3, depending on requirements for the fluid. Return of fluid to tank 15 is shown in FIG. 5. For a diesel engine, all cleaning fluid whether from a kinetic or static clean should be discarded as these oils once contaminated generally contain too much carbon, whereas for a petrol engine the cleaning fluid used for a static clean may be used a predetermined number of times, particularly if it follows a kinetic flush in which the fluid has been discarded.

Simultaneously with the draining or pumping out of the cleaning fluid from the engine 2, compressed air mixed with a high slip oil may be blown into the air galleries to pressurise the engine 2 and help remove more residual oil after draining. The high slip oil replaces fluid on the bearing surfaces, creating a lubricating fluid on those surfaces. The compressed air may be fed into the engine 2 through air input 20, or alternatively through another air input.

After the kinetic and/or static clean of the engine 2 and draining of the cleaning fluid, a certain amount of fluid still remains in the engine 2. This would contaminate the fresh oil placed in the engine 1, reducing the performance of the oil. Therefore, the apparatus 1 performs a neutralising flush of the engine 2.

Figure 6:
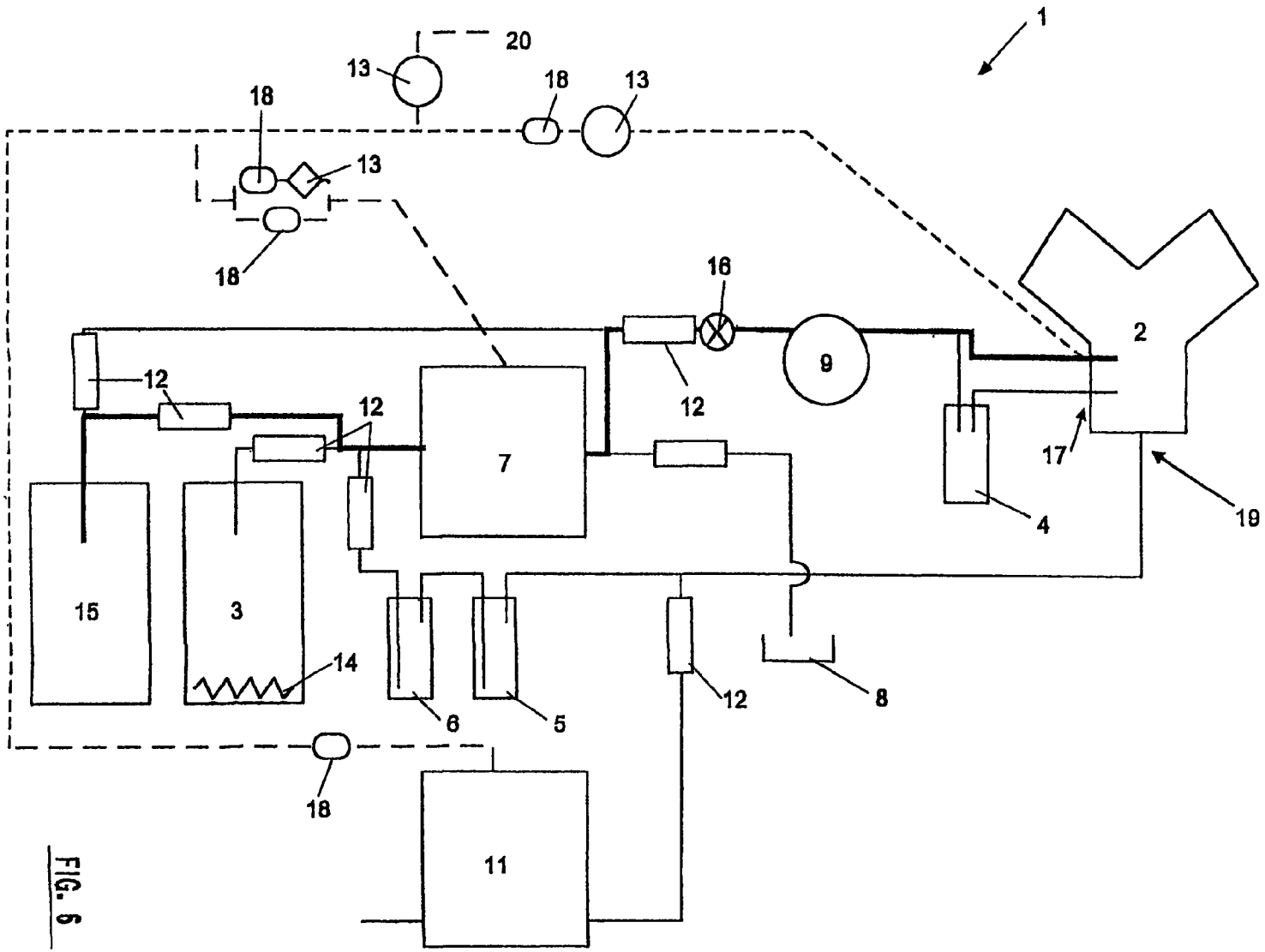
FIG. 6: Shows the apparatus of FIG. 1 in the neutralising fluid fill part of the cleaning cycle.

A neutralising fluid is retained in tank 15 and is transferred into engine 2 as illustrated in FIG. 6. The tank 15 may include a heater 14' to raise the temperature of the cleaning fluid if required. The neutralising fluid is a fluid adapted to combine or react with the cleaning fluid to result in a fluid with which fresh oil may mix without significantly degrading the quality of the oil. The neutralising fluid also has sufficient lubrication properties to ensure that the bearing surfaces of the engine 2 retain adequate lubrication during initial start-up of the engine 2 after cleaning.

An example of a suitable neutralising fluid is Titan™ Heavy Duty Neutralising Fluid 2864, available from Fuchs Lubricants (Australasia) Pty Ltd. This neutralising fluid is designed to be used in conjunction with Titan™ Heavy Duty Flushing Fluid 2864. It will be appreciated by those skilled in the art that variations and modifications from the characteristics of these oils may be made depending on the specific cleaning fluid used, the fresh oil used and the specific requirements of the system. In particular, it is anticipated that specific neutralising fluids and/or cleaning fluids may be formulated for specific oils.

The neutralising fluid is flushed around the engine 2 in the same manner as a static clean for the cleaning fluid and then drained either back to the tank 15 or to waste 8 depending on the requirements for the fluid. Alternatively, the machine may be operated during circulation of the neutralising fluid. A single supply of neutralising fluid may be suitable for several flushes through an engine 2, given that the engine has just been cleaned by the cleaning fluid. Any remaining fluid does not have any substantial adverse effect on the quality of fresh oil placed in the engine 2.

The neutralising fluid and cleaning fluid may be kept separate after use, allowing re-use of these fluids if required. The apparatus 1 may control whether or not the fluids are made available for re-use dependent on information provided about the fluids. This information may be part of the product information, or may be stored in the apparatus 1 and the product information compared to the stored information to determine whether the fluid can be reused.

The apparatus 1 may include a memory for recording various information regarding the operation of the apparatus 1. This may include the number of cleans performed, product information regarding the fluids used and timing of the cleans performed.

Finally, all conduits are then removed from the adaptable connectors. The sump plug and oil filter are replaced and the engine is filled with oil.

Where in the foregoing description reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the appended claims.

The invention claimed is:

1. A method of cleaning a lubrication system of a machine comprising the steps of:

(a) removing existing lubricating fluid from the machine;

(b) circulating a cleaning fluid through the machine;

(c) removing the cleaning fluid from the machine;

(d) circulating a neutralising fluid through the machine, wherein the neutralising fluid is adapted to combine or react with the cleaning fluid to produce a fluid that does not adversely affect the lubrication characteristics of fresh lubricating fluid when mixed with the fresh lubricating fluid; and (e) removing the neutralising fluid from the machine.

2. The method of claim 1, further comprising the steps of refilling the machine with a required amount of said fresh lubrication fluid.

3. The method of claim 1, further comprising the step of circulating the cleaning fluid through the machine more than once and passing the cleaning fluid through at least one filter for each cycle.

4. The method of claim 1, further comprising the step of operating the machine while the cleaning fluid is within the machine.

5. The method of claim 4, further comprising the step of circulating the neutralising fluid through the machine while the machine is not operating.

6. The method of claim 1, further comprising the step of feeding compressed air into the lubrication system through an inlet as the cleaning fluid is being removed from the machine.

7. The method of claim 6, further comprising the step of mixing a lubricant with the compressed air and circulating the mixture through the lubrication system.

8. The method of claim 1 when applied to a lubrication system of an internal combustion engine.

9. A method of cleaning a lubrication system of a machine comprising the step of:

(a) removing existing lubricating fluid from the machine;

(b) circulating a cleaning fluid through the machine;

(c) removing the cleaning fluid from the machine;

(d) supplying compressed air at an inlet of the lubrication system and removing the cleaning fluid from the machine through an outlet of the lubrication system;

(e) circulating a neutralising fluid through the machine, wherein the neutralising fluid is adapted to combine or react with the cleaning fluid to produce a fluid that does not adversely affect the lubrication characteristics of fresh lubricating fluid when mixed with the fresh lubricating fluid; and (f) removing the neutralising fluid from the machine.

10. The method of claim 9, further comprising the step of mixing a lubricant with the compressed air and circulating the mixture through the lubrication system.

11. The method of claim 9, further comprising the step of circulating the cleaning fluid and/or neutralising fluid for a predetermined time.

12. The method of claim 9, when applied to an internal combustion engine.

* * * * *